United States Patent [19]

Takami

[11] Patent Number: 4,842,215

[45] Date of Patent: Jun. 27, 1989

[54] TAPE ROLLING UP DEVICE OF PACKAGE STRAPPING MACHINE

[76] Inventor: Masaho Takami, 9-50, Kohrienyamanote-cho, Hirakata-shi, Japan

[21] Appl. No.: 176,174

[22] Filed: Mar. 31, 1988

[30] Foreign Application Priority Data

Oct. 31, 1987 [JP] Japan ..... 62-167179[U]

[51] Int. Cl.[4] ..... B65H 59/02; B65H 23/08

[52] U.S. Cl. ..... 242/156; 242/75.4; 242/129.3; 242/129.8

[58] Field of Search ..... 242/156, 156.2, 75.4, 242/54 R, 129.3, 129.1, 107.3, 129.8

[56] References Cited

U.S. PATENT DOCUMENTS

| | | | |
|---|---|---|---|
| 218,974 | 8/1879 | Howard | 242/129.3 X |
| 460,723 | 10/1891 | Eisenhart | 242/156 X |
| 644,429 | 2/1900 | Irwin | 242/107.3 |
| 877,232 | 1/1908 | Rolland Jr. | 242/75.4 |
| 1,135,702 | 4/1915 | Larson | 242/156 |
| 1,225,658 | 5/1917 | Lawrence | 242/156 |
| 2,139,784 | 12/1938 | Wengel | 242/75.4 |
| 2,406,846 | 9/1946 | Muller | 242/156 X |
| 2,534,598 | 12/1950 | Houghton | 242/75.4 X |
| 4,462,551 | 7/1984 | Bloch | 242/129.3 X |

FOREIGN PATENT DOCUMENTS

| | | | |
|---|---|---|---|
| 9688 | 4/1970 | Japan | 242/129.3 |
| 115331 | 5/1918 | United Kingdom | 242/75.4 |
| 1280015 | 7/1972 | United Kingdom | 242/156 |
| 1318746 | 5/1973 | United Kingdom | 242/156 |

*Primary Examiner*—Stanley N. Gilreath

*Attorney, Agent, or Firm*—Wenderoth, Lind & Ponack

[57] ABSTRACT

A package strapping machine is provided with a tape rolling up device for rolling up excess tape drawn off of a tape reel. A package is strapped by a thermoplastic tape being drawn off of the tape reel and looped around the package. The tape reel is fixed to a rotatably supported shaft. The tape rolling up device includes a friction member surrounding the shaft, and a spiral spring has an inner end connected to the friction member and an outer end connected to a fixed point. The shaft includes a surface contacting the friction member, so that when the tape is drawn off, rotation of the shaft causes rotation of the friction member and tightening of the spiral spring. If tape continues to be drawn off after the spiral spring is completely tightened, slip occurs between the friction member and the shaft contact surface to allow the additional tape to be drawn off. When excess tape is then generated by tape being fed back toward the tape reel by the package strapping machine, the spiral spring has an accumulated spring force to rotate the tape reel to wind the excess tape.

9 Claims, 3 Drawing Sheets

TAPE ROLLING UP DEVICE OF PACKAGE STRAPPING MACHINE

BACKGROUND OF THE INVENTION

The present invention relates to a tape rolling up device for rolling up a tape drawn out from a tape reel in a package strapping machine.

The package strapping machine draws a thermoplastic tape from the reel, and winds it around a package. The strap is tightened, and both ends of the tape are heated and pressed in order to weld them together. Package strapping machines have been widely used for packaging various kinds of articles.

A general construction of the package strapping machine is shown in FIG. 1. A base 1 is supported by a table, carrying a package A to be strapped thereon, so as to be laterally movable. A first clamp 2, a pressing means 3 and a second clamp 4 are disposed side by side immediately below the base 1. They are raised and lowered by a group of cams 6 on a cam shaft 5, driven by means of a motor M1. A tape-cutting mechanism 17 is disposed between an upper end of the first clamp 2 and an upper end of the pressing means 3. A heater (not shown) is advanced into and retreated out of a space between the base 1 and the pressing means 3.

A thermoplastic tape B is drawn out from a reel 7 onto the table from a space between a pair of tape delivery and tightening rolls 8, 9, that is, an upper tape delivery and tightening roll 8 and a lower tape delivery and tightening roll 9. The tape feeds through a tape guide 10 and a guide groove 11 of the first clamp 2, loops around the package on the table, and a leading end of the tape is then inserted beneath a lower surface of the base 1. Upon the pushing of a switch (not shown) by the leading end of the tape B, a motor M1 is started to begin the tightening and welding operation.

Of the above described tape delivery and tightening rolls 8, 9, the upper roll 8 is driven forwardly and reversely by means of a motor M2, while the lower roll 9 is pulled up by means of a spring 12, pressing it against the upper roll 8, and this pressing force serves as a tape delivery force.

In addition, the lower roll 9 is pushed up by means of a cam 13 mounted on the cam shaft 5 through a rotor 14 and a spring 15. During a tape tightening process a tape holding force is thus enhanced, whereby the tape can be tightened without slipping, to tightly tie the package A being strapped.

However, with the above described package strapping machine, when the tape B is tightened by means of the tape delivery and tightening rolls 8, 9, the tape B becomes loose in the area between the rolls 8, 9 and the reel 7. If this loosened portion of the tape is not taken up, the tape can become tangled.

By connecting an inner end of a spiral spring to the tape reel 7, tightening the spiral spring to accumulate a spring force when the tape is drawn out, and rotating the reel by the accumulated spring force when the tape is tightened, a simple method of taking up the loosened portion of the tape is achieved.

In order to roll up an excessively long tape by means of a spiral spring, a spiral spring which is comparatively rigid and has a large number of turns would be required.

However, a problem occurs in a situation where the torque of the motor M2 driving the tape delivery and tightening rolls 8, 9 is relatively small, as in a small-sized semiautomatic bench package strapping machine. Such a machine is used for packaging weak and small articles such as cake boxes or lunch boxes. If a force of the spiral spring is relatively large, the torque of the motor M2 may be less than the force of the spiral spring, preventing the delivery of the tape.

OBJECTS OF THE INVENTION

It is a first object of the present invention to provide a tape rolling up device capable of satisfactorily achieving the delivery of a tape and the take up of an excess portion of the tape, even though the torque of the motor driving tape delivery and tightening rolls is relatively small.

It is a second object of the present invention to provide a tape rolling up device capable of setting the tape rolling up conditions depending upon the packaging conditions.

The above described and further objects and features of the present invention will be obvious in more detail from the following description with reference to accompanying drawings showing preferred embodiments.

DETAILED DESCRIPTION OF THE INVENTION

Figure 2:
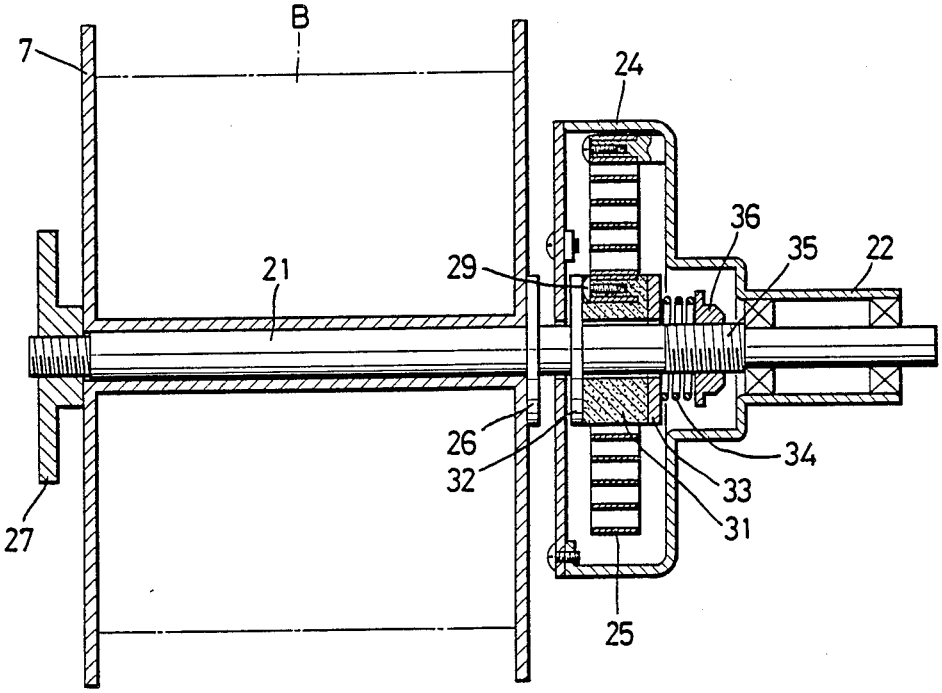
FIG. 2 is a longitudinally sectioned front view showing a first preferred embodiment of a tape rolling up device according to the present invention.
Figure 3:
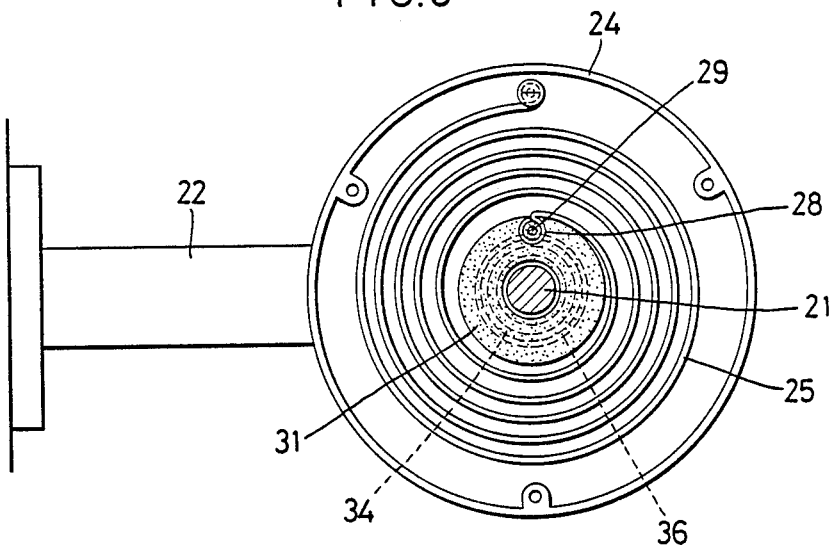
FIG. 3 is a longitudinally sectioned side view showing the first preferred embodiment of a tape rolling up device according to the present invention.

In the first preferred embodiment shown in FIGS. 2 and 3, a ring frictional member 31 is mounted on a shaft 21, shaft 21 being rotatably supported by a bearing 22 fixedly mounted on a package strapping machine in a horizontal manner. A fixed collar 32 is integrally formed with the shaft 21, and a movable plate 33 surrounds the shaft 21 with a slight gap. The movable plate 33 and the fixed collar 32 sandwich the frictional member 31 between them. Frictional member 31 is biased against fixed collar 32 by the movable plate 33 and an elastic member or spring 34.

A spiral spring 25 is disposed between the frictional member 31 and a cover 24 extending from the bearing 22. An inner end of the spiral spring 25 is fixedly mounted on the frictional member 31 by means of a groove 28 and a pin 29. An outer end of the spiral spring 25 is fixedly mounted on the cover 24.

The frictional member 31 has an inside diameter capable of freely rotating around the shaft 21. It is elastically held between the fixed collar 32 and the movable plate 33 so as to rotate integrally with the shaft 21. A frictional force is generated on sliding surfaces on both sides of the frictional member, on which the fixed collar 32 and the movable plate 33 slide. Slipping between the sliding surfaces and the frictional member is used to allow the shaft 21 to rotate relative to the frictional member 31 when the tightening force of the spiral spring 25 exceeds the frictional force.

The elastic member 34 is compressed between a nut 36 screwed on screw threads 35 of the shaft 21 and the movable plate 33. The nut 36 may be turned to change the compression of the elastic member 34, so that the frictional force generated between the frictional member 31 and the fixed collar 32 and the movable plate 33 can be adjusted to match the packaging conditions.

Figure 1:
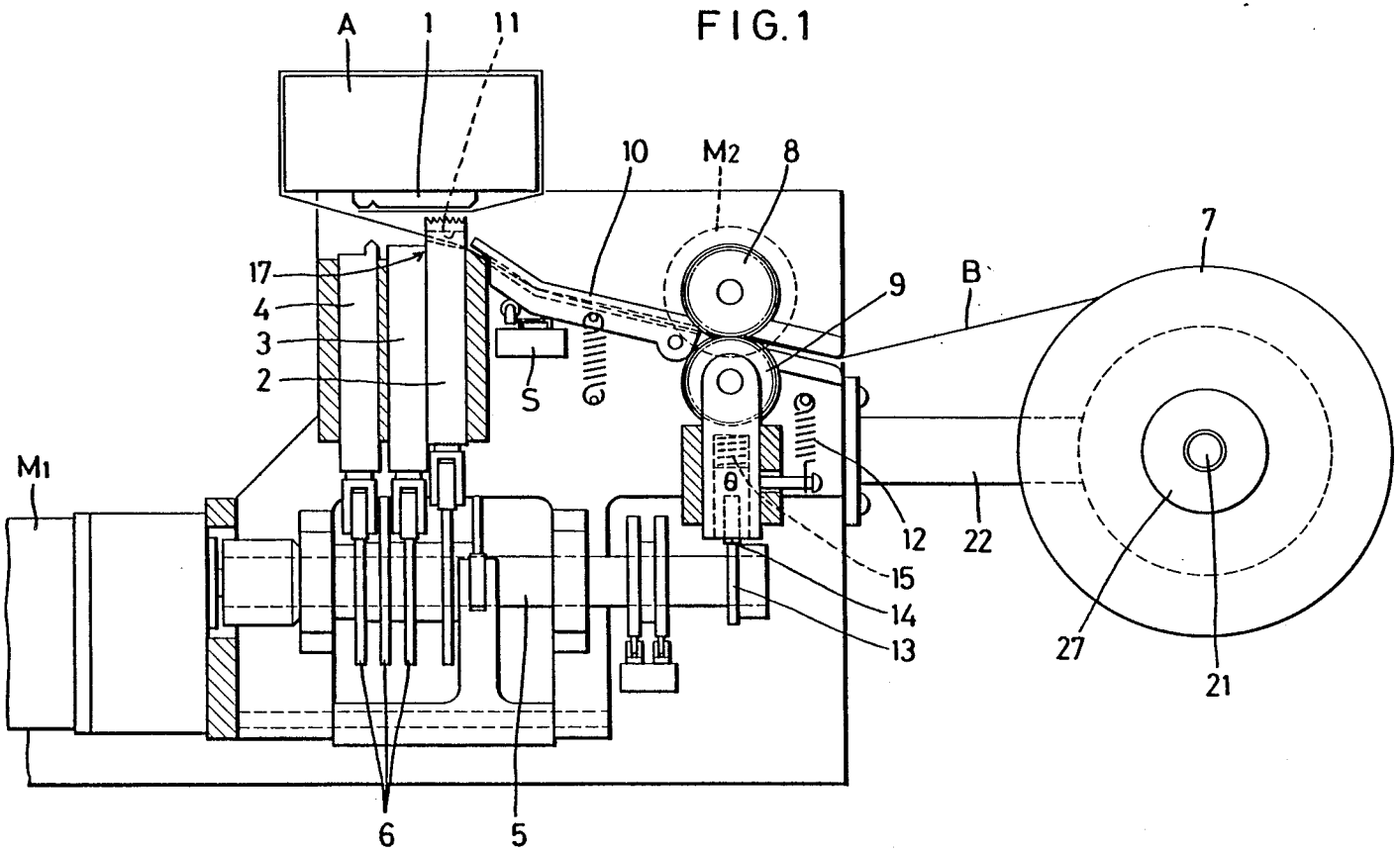
FIG. 1 is a longitudinally sectioned side view showing a package strapping machine using a tape rolling up device according to the present invention.

Due to the frictional force generated on the sliding surfaces between the frictional member 31 and the fixed collar 32 and the movable plate 33, the frictional member 31 is rotated integrally with the shaft 21 to tighten the spiral spring 25 when the tape is delivered. Slipping is generated on the sliding surfaces to rotate only the shaft 21 when the spiral spring 25 is wholly tightened. The frictional force is set so as to rotate the shaft 21 in the direction in which the tape B is rolled up, by a force accumulated in the spiral spring 25. The set frictional force depends upon the torque of the motor M2 driving the tape delivery and tightening rolls 8, 9, shown in FIG. 1, and the elasticity of the spring 12.

The force of the delivery spring 12 of the tape delivery and tightening rolls 8, 9 is set so that the elasticity of the delivery spring 12 may exceed that of the spiral spring 25, to allow the spiral spring 25 to tighten when the tape B is delivered.

The first preferred embodiment of the tape rolling up device according to the present invention has the above described construction. In operation, the tape B drawn out from the reel 7 is delivered onto the table to a predetermined length by the rotation of the tape delivery and tightening rolls 8, 9 by the motor M2 in the delivering direction. The shaft 21 is rotated together with the reel 7 by drawing out the tape B, the spiral spring 25 being tightened by means of the frictional member 31 rotating in the same direction. When the spiral spring 25 is completely tightened, slip is brought about on the sliding surfaces between the frictional member 31 and the fixed collar 32 and the movable plate 33. The shaft 21 rotates relative to the stopped frictional member 31, so that the motor M2 can continue to deliver the tape for a designated time.

Upon looping the tape B around the package A being strapped, and inserting its leading end beneath the lower surface of the base 1, the motor M1 is started to first raise the first clamp 2, whereby the inserted end of the tape B is clamped by the first clamp 2 and the base 1. Then the motor M2 is reversely rotated, and the tape B thus is pulled back by the rolls 8, 9. The tape B is wound and tightened about package A, and upon detecting that the tension of the tape is at a predetermined value by means of the tape guide 10 and the switch, the second clamp 4 is raised, and the pressing means 3 is raised to cut the lower tape. The heater enters a space between the upper tape and the lower tape, whereby both ends of the tape B are welded together by heating under pressure.

When the tape is tightened, the tape returned to reel 7 from the rolls 8, 9 is rolled up by the rotation of the reel 7. This is due to the accumulated spring force of the spiral spring 25, and prevents the tape B from getting loose in the area between the rolls 8, 9 and the reel 7.

After welding both ends of the tape B together, the first clamp 2, the pressing means 3 and the second clamp 4 are lowered, and the base 1 is drawn out from between the tape B and the package A. Thus, the next packaging process is ready.

As described above, with the tape rolling up device according to the first preferred embodiment, upon rotating the shaft by the delivery of the tape, the frictional member is also rotated in the same direction by the frictional force generated on the sliding surfaces between the frictional member and the fixed collar and the movable plate. The spiral spring is tightened to accumulate the spring force, whereby the reel can be rotated in the tape rolling up direction. the spring force accumulated in the spiral spring during the tape delivery process allows the excess tape formed in the tape tightening process to be rolled up on the reel to prevent the tape from getting loose.

Since the frictional member 31 is between the fixed collar 32 and the movable plate 33 with the pressing force of the spring 34 to generate the frictional force on the sliding surfaces, a desired frictional force can be obtained by adjusting the spring 34. Though the sliding surfaces of the frictional member may be worn, the required tightened condition of the spiral spring can thus always be obtained.

Furthermore, the frictional force can be optionally set by changing the pressing force of the elastic member or spring 34 to obtain the frictional force matching the packaging conditions.

Figure 4:
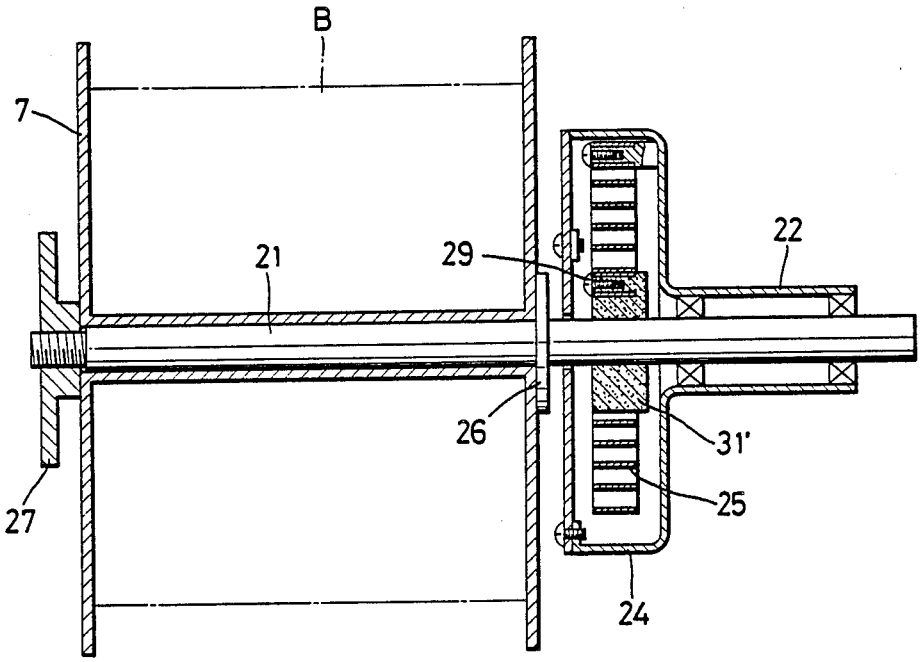
FIG. 4 is a longitudinally sectioned front view showing a second preferred embodiment of a tape rolling up device according to the present invention.
Figure 5:
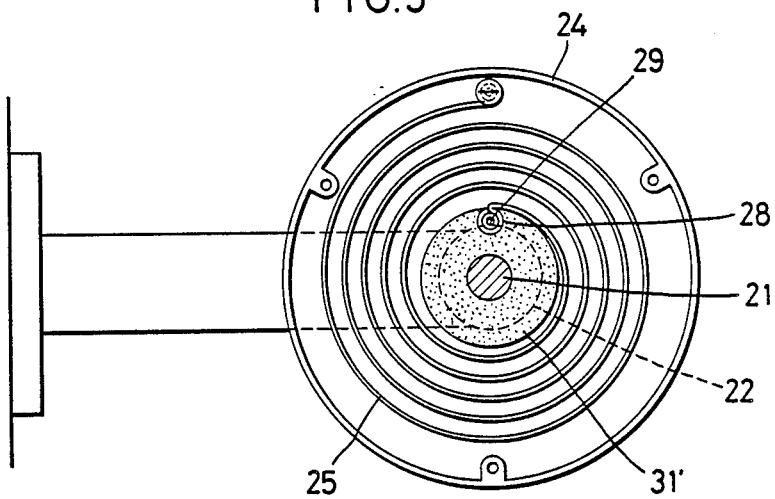
FIG. 5 is a longitudinally sectioned side view showing the second preferred embodiment of a tape rolling up device according to the present invention.

Next, the second preferred embodiment shown in FIGS. 4 and 5 is described.

This second preferred embodiment is obtained by simplifying the first preferred embodiment in construction. Parts similar to those in the first preferred embodiment are marked with the same reference numerals.

One end of a shaft 21 is rotatably supported in a horizontal manner by means of a bearing 22 fixedly mounted on a package strapping machine. A reel 7 is detachably mounted on the shaft 21, and a spiral spring 25 is incorporated between a frictional member 31' surrounding the shaft 21 and a cover 24 covering an outside of the frictional member 31'.

The shaft 21 mounts the reel 7 by fixedly mounting a stopper 26 on the shaft 21 and fixing the reel 7 on the shaft 21 between a clamp screw 27, screwed on an end of the shaft 21, and the stopper 26, so as to have the reel 7 rotate integrally with the shaft 21.

The frictional member 31' is formed as a ring made of elastic materials, such as rubber and synthetic resins, having an inside diameter such that the elasticity of frictional member 31' holds it on the shaft 21. The spiral spring 25 is connected to the frictional member 31', an inner end of the spiral spring 25 being engaged with an inside of a groove 28 formed in a periphery of the frictional member 31' and connected by means of a pin 29. An outer end of the spiral spring 25 is fixedly mounted on the fixed cover 24 extending from the bearing 22.

The above described spiral spring 25 is tightened to accumulate the spring force when the shaft 21 is rotated in the direction in which the tape B is drawn out, and this spring force leads to the rotation of the shaft 21 in the direction in which the tape is rolled up.

The frictional resistance of the frictional member 31' against the shaft 21 is chosen depending upon the torque of the motor M2 driving the tape delivery and tightening rolls 8, 9, and the force of the spring 12, so that the frictional member 31' rotates integrally with the shaft 21 without slipping when the tape is delivered to tighten the spiral spring 25, and the frictional member 31' slips against the shaft 21 when the spiral spring 25 is completely tightened. the shaft 21 then rotates by the force accumulated in the spiral spring 25 in the tape tightening process.

The force of the spring 12 of the tape delivery and tightening rolls 8, 9 is set at the elasticity overcoming the spiral spring 25, so that the spiral spring 25 may be tightened when the tape B is delivered.

Upon delivering the tape B by means of the tape delivery and tightening rolls 8, 9, the shaft 21 is rotated together with the reel 7 by the tape B drawn out from the reel 7 to tighten the spiral spring 25.

If the tape continues to be delivered when the spiral spring 25 is tightened, the friction member 31' slips against the shaft 21 to allow just the shaft 21 to rotate, allowing continued delivery of the tape.

In the tape tightening process, the reel 7 is rotated in the tape rolling up direction by the force accumulated in the spiral spring 25. The excess tape returned from the tape delivery and tightening rolls 8, 9 is rolled up by the reel 7 to prevent the tape from getting loose.

What is claimed is:

1. A tape rolling up device for a package strapping machine, comprising:

a rotatably supported shaft;

a tape reel mounted on said shaft;

a frictional member surrounding said shaft;

said shaft having an integral contact surface frictionally engaging one side of said frictional member, said integral contact surface comprising a fixed collar on said shaft;

a movable plate contacting another side of said frictional member, thereby sandwiching said frictional member between said fixed collar and said movable plate;

means for biasing said movable plate toward said fixed collar, thereby frictionally engaging said fixed collar and said frictional member; and a spiral spring having an inner end connected to said frictional member and an outer end connected to a fixed member, whereby a tape being drawn off of said tape reel causes said shaft to rotate said fixed collar and thereby rotate said frictional member to wind said spiral spring, thus storing a tape rolling up force in said spiral spring.

2. The tape rolling up device of claim 1, wherein said spiral spring surrounds said frictional member.

3. The tape rolling up device of claim 2, further comprising a housing surrounding said spiral spring, said frictional member, and said fixed collar, said fixed member being said housing.

4. The tape rolling up device of claim 3, wherein said housing also houses a bearing supporting an end of said shaft.

5. The tape rolling up device of claim 1, wherein:

a stopper is fixed to said shaft;

said shaft has a threaded end;

a clamp screw is screwed onto said threaded end of said shaft; and said tape reel is held between said stopper and said clamp screw so as to rotate with said shaft.

6. The tape rolling up device of claim 1, wherein said frictional member comprises a ring-shaped member.

7. The tape rolling up device of claim 6, wherein said spiral spring inner end is connected to said frictional member via a groove and pin connection.

8. The tape rolling up device of claim 1, wherein said frictional member comprises a ring member having an inside diameter slightly greater than an outside diameter of said shaft at an area of said shaft where said frictional member surrounds said shaft.

9. The tape rolling up device of claim 1, wherein said means for biasing said movable plate comprises a nut threaded onto said shaft and a spring disposed between said nut and said movable plate, whereby adjustment of said nut on said shaft adjusts a frictional force between said frictional member and said fixed collar.

* * * * *